US008556680B2

(12) United States Patent
Wenninger

(10) Patent No.: US 8,556,680 B2
(45) Date of Patent: Oct. 15, 2013

(54) PROCESS AND APPARATUS FOR AUTOMATICALLY GRINDING EDGES OF GLASS SHEETS UNDER CLEAN ROOM CONDITIONS

(75) Inventor: Egbert Wenninger, Rain (DE)

(73) Assignee: Grenzebach Maschinenbau GmbH, Asbach-Baeumenheim (DE)

( * ) Notice: Subject to any disclaimer, the term of this patent is extended or adjusted under 35 U.S.C. 154(b) by 311 days.

(21) Appl. No.: 12/996,305

(22) PCT Filed: Jun. 2, 2009

(86) PCT No.: PCT/DE2009/000772

§ 371 (c)(1),
(2), (4) Date: Dec. 3, 2010

(87) PCT Pub. No.: WO2009/146685

PCT Pub. Date: Dec. 10, 2009

(65) Prior Publication Data

US 2011/0104988 A1 May 5, 2011

(30) Foreign Application Priority Data

Jun. 6, 2008 (DE) ..... 10 2008 027 050

(51) Int. Cl.
*B24B 49/10* (2006.01)
*B24B 9/10* (2006.01)

(52) U.S. Cl.
USPC ..... 451/8; 451/44

(58) Field of Classification Search
USPC ..... 451/44, 43, 5, 8, 9, 73, 21
See application file for complete search history.

(56) References Cited

U.S. PATENT DOCUMENTS

| | | | | |
|---|---|---|---|---|
| 4,587,769 | A * | 5/1986 | Cathers | 451/21 |
| 4,594,814 | A | 6/1986 | Olszewski et al. | |
| 4,872,289 | A | 10/1989 | Yukawa et al. | |
| 6,099,385 | A * | 8/2000 | Stock et al. | 451/8 |
| 6,196,902 | B1 * | 3/2001 | Gazca-Ortiz et al. | 451/242 |
| 7,125,320 | B1 * | 10/2006 | Brown et al. | 451/44 |
| 2003/0181145 | A1 | 9/2003 | Collins et al. | |
| 2005/0090189 | A1 | 4/2005 | Brown et al. | |
| 2007/0141961 | A1 | 6/2007 | Brown et al. | |

FOREIGN PATENT DOCUMENTS

| | | |
|---|---|---|
| DE | 129 751 | 2/1978 |
| DE | 1290751 | 2/1978 |
| DE | 32 31 895 A1 | 8/1982 |
| DE | 85 03 914.4 | 7/1985 |
| EP | 0 315 202 A2 | 5/1989 |
| EP | 1 491 288 B1 | 12/2004 |

(Continued)

*Primary Examiner* — Robert Rose
(74) *Attorney, Agent, or Firm* — Slater & Matsil, L.L.P.

(57) ABSTRACT

An embodiment of the invention relates to a method and an apparatus for the automatic edge grinding of glass sheets under clean room conditions, comprising the following: a) a multi-axis robot at a gripper arm thereof carries a suction frame having a plurality of suction units for receiving a glass sheet, b) a grinding unit having at least one rotatable grinding wheel that is supported in a stationary manner is installed in the usable pivot range of the gripper arm of the robot, c) the ground product occurring during operation of the grinding unit is extracted by an extraction system, d) the degree of wear and the state of the grinding wheel are monitored by a calibration device in conjunction with a detection device, and a computer program for carrying out the method.

20 Claims, 5 Drawing Sheets

(56) References Cited

FOREIGN PATENT DOCUMENTS

| | | | |
|---|---|---|---|
| JP | 49-43354 | B | 11/1974 |
| JP | 63-4258 | | 1/1988 |
| JP | 5-5594 | A | 1/1993 |
| JP | 10-559 | A | 1/1998 |
| JP | 10-309666 | A | 11/1998 |
| JP | 2000-52213 | A | 2/2000 |
| JP | 2004-25357 | A | 1/2004 |
| JP | 2007165488 | A | 6/2007 |
| KR | 1992-0009812 | B1 | 10/1992 |

* cited by examiner

PROCESS AND APPARATUS FOR AUTOMATICALLY GRINDING EDGES OF GLASS SHEETS UNDER CLEAN ROOM CONDITIONS

This patent application is a national phase filing under section 371 of PCT/DE2009/000772, filed Jun. 2, 2009, which claims the priority of German patent application 10 2008 027 050.4, filed Jun. 6, 2008, each of which is incorporated herein by reference in its entirety.

BACKGROUND

In many cases, modern glass facades are not just a functional element of a structure, but in fact also serve increasingly for generating solar energy. Tailored solar modules make accurate integration into building grids and profiles possible. Semitransparent solar cells, but also opaque solar cells with transparent areas, make photovoltaic glazings appear to be flooded with light. Here, the solar cells often take on the desired effect of protection against the sun and glare.

The production of such photovoltaic systems requires operating conditions such as those which are conventional primarily in the production of semiconductors and integrated electronic circuits. In the production of photovoltaic systems, these so-called clean room conditions also additionally make it necessary to handle shock-sensitive glass sheets with a large surface area.

For the safe handling of such glass sheets, it is necessary to remove the sharp edges which arise during chipping to the required formats and to grind down said edges.

For this purpose, DD 129751 PS has disclosed a vacuum clamping apparatus for machines for processing edges of glass sheets.

Said clamping apparatus is based on the object of reducing the expenditure on time and work during the clamping and release of the glass sheets by corresponding vacuum control.

In order to achieve this object, said document describes a vacuum clamping apparatus for machines for grinding and polishing the edges on round and oval glass sheets, which is characterized in that a compressed air supply apparatus is connected to the vacuum clamping device and can be connected to a clamping plate by a line provided with a shut-off valve via a vacuum line and to a solenoid valve, which shuts off the vacuum line, via a line containing a shut-off valve which opens only temporarily. In addition, a contact manometer is connected to the vacuum line and initiates sequence control when a minimum vacuum is reached.

Apart from the measure of using vacuum control for clamping and releasing a glass sheet for the purpose of processing edges of glass sheets, said document provides no indication of the automatic grinding of edges of glass sheets.

Furthermore, DE 85 03 914 U1 discloses an edge grinding machine, which is based on the object of designing an edge grinding machine in such a manner that, when profiled circumferential grinding wheels are used, it is possible to set the required operational distance between the circumferential grinding wheel units quickly, without any problems and reliably.

This is achieved substantially by virtue of the fact that the distance between the circumferential grinding wheel units is fixed by end stops which can move in the movement path of the circumferential grinding wheel units, and that each circumferential grinding wheel unit is assigned a plurality of end stops, of which in each case one lies in the movement path of the circumferential grinding wheel unit.

This design has the advantage that no skill or special care is required whatsoever in the event that the distance between the circumferential grinding wheel units needs to be changed, since it is merely necessary to move a predefined end stop in order to move the corresponding circumferential grinding wheel units into the desired position.

Although this simplifies operation, it does not indicate a system for automatically grinding edges of glass sheets.

Furthermore, DE 32 31 895 A1 discloses a machine for chamfering edges of sheet-like workpieces, in particular glass panes, in which a grinding wheel arrangement is used to grind down at least one edge of the workpiece during a relative movement between the workpiece and the grinding wheel arrangement.

In the case of this machine, the quality of the chamfered edges should be improved to the effect that the grinding tracks which are clearly apparent in the case of prior art machines are reduced.

For this purpose, it is provided in DE 32 31 895 A1 that the grinding wheel arrangement has at least one circumferential grinding wheel, preferably two circumferential grinding wheels for simultaneously grinding two adjacent edges, and the axes of rotation of said circumferential grinding wheels are arranged substantially parallel to the edges to be ground during grinding.

This machine too is not suitable for automatically grinding edges of glass sheets.

Furthermore, US 2003/0181145 A1 discloses an apparatus for polishing the edge of a glass pane which is moved along a polishing wheel by means of a separate drive. In this document, a pressure subassembly is used to ensure that a predetermined constant contact pressure prevails between the polishing wheel and the edge of the moving glass pane. The waste produced during the polishing operation is disposed of. This known apparatus is not suitable, however, for the degrees of purity required in clean rooms.

In the case of a partially comparable apparatus, known from U.S. Pat. No. 6,099,385, for removing a protruding edge of a plastic lamination in a pane of safety glass, an apparatus for monitoring the wear of the grinding wheel is additionally also provided. This is substantially used to keep the contact pressure between the product for grinding and the grinding wheel constant and to compensate for the reduction in the diameter of the grinding wheel brought about by wear by means of an increased rotational speed. The extraction apparatus provided here serves for rough removal of plastic fragments from the plastic lamination which is ground down. Said apparatus is not suitable for grinding edges of glass sheets under clean room conditions.

A further comparable system design is known from EP 1 491 288 A1. This document describes specific methods for guiding a glass sheet along a grinding wheel using a robot hand. As a result, the accuracy of the chamfering obtained should be increased and the process time should be reduced. This document does not refer to the removal of the grinding dust, in particular under clean room conditions.

The special requirements for systems for grinding edges of glass sheets in clean rooms are therefore not taken into consideration in the prior art.

SUMMARY OF THE INVENTION

One aspect of the invention is therefore based on specifying a process, and an apparatus, which makes it possible to automatically grind edges of glass sheets under clean room conditions at low cost, quickly and reliably.

This is achieved by an apparatus having the features of claim 1 and by a corresponding process as claimed in claim 7.

BRIEF DESCRIPTION OF THE DRAWINGS

In the text which follows, embodiments of the invention are described in more detail on the basis of figures.

Figure 1:
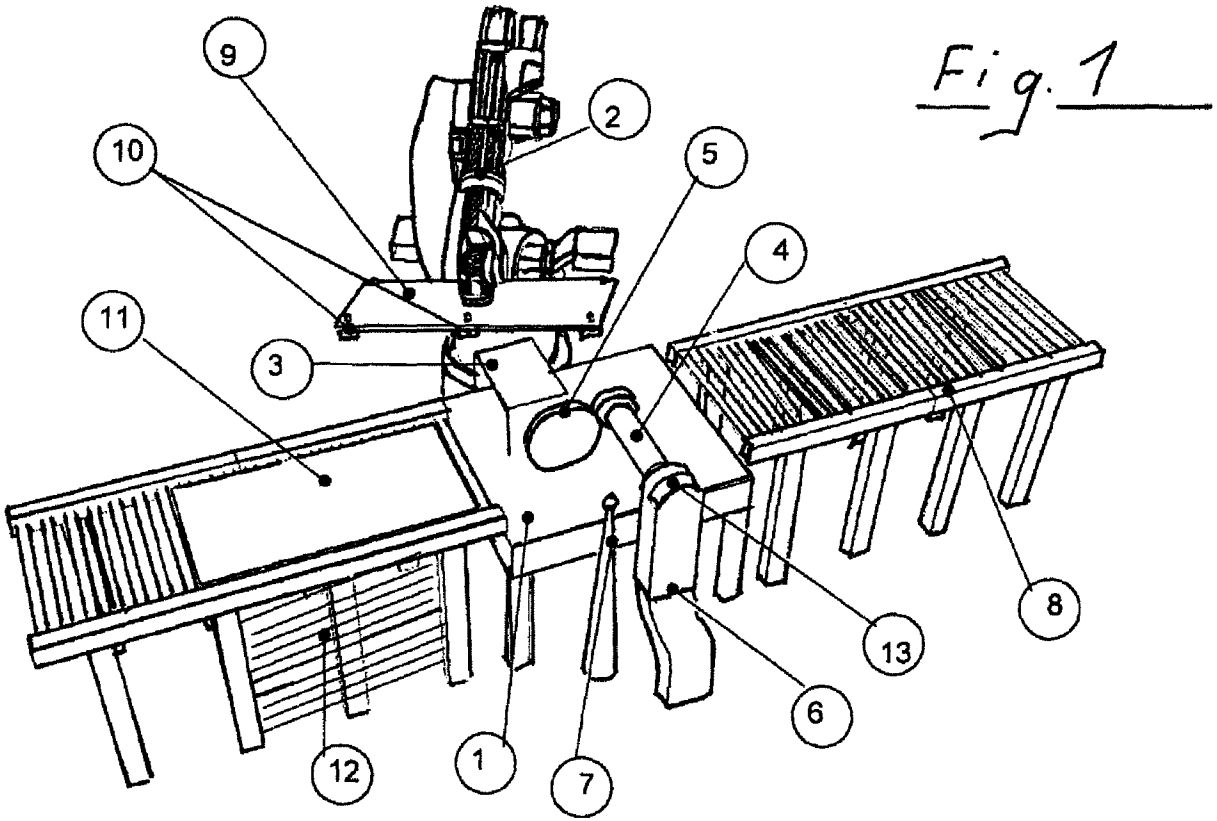
FIG. 1: is a perspective illustration of the overall apparatus during use in the region of a production line

The following list of reference symbols may be used in conjunction with the drawings:

(1) Base frame (grinding unit)
(2) Robot
(3) Drive of the grinding unit
(4) Grinding wheel spindle
(5) Gear mechanism for the grinding unit
(6) Housing for the extraction device
(7) Position sensor
(8) Roller conveyor
(9) Suction frame
(10) Suction unit
(11) Glass sheet
(12) Receiver stack
(13) Grinding wheel
(14) Main extraction duct
(15) Supply of the grinding emulsion
(16) Annular extraction on the sealing lip
(17) Sealing lip
(18) Grinding wheel calibration device in conjunction with a detection device

DETAILED DESCRIPTION OF ILLUSTRATIVE EMBODIMENTS

FIG. 1 illustrates the overall apparatus in a bird's-eye view during use in a production line.

Here, the production line is represented by the left-hand and right-hand parts of a roller conveyor (8). A resting glass sheet (11) is sketched on the left-hand part of the roller conveyor (8). A receiver stack (12) consisting of a plurality of glass sheets (11) lying on top of one another is likewise shown in this region in place of the left-hand part of the roller conveyor (8). This is intended to demonstrate that, as a supply medium, it is possible both to choose a production line in the form of a roller conveyor and to remove the glass sheets (11) to be processed from a receiver stack.

In the example shown in FIG. 1, the base frame (1), which bears the essential parts of the grinding apparatus according to an embodiment of the invention, is inserted in the path of a production line.

The arm of the multi-axis robot (2) (shown in the background) is equipped at its end with a rectangular suction frame (9), which is provided, in each case at the ends of its two transverse sides and in the center of the two longitudinal sides, with a square-shaped suction unit (10).

A suction unit (10) of this type is matched to the angular structure of a glass sheet owing to its shape. It is compact and has very strong suction. The system for producing, controlling and distributing the suction air required to attract a glass sheet (11) to be received by suction is not illustrated in the figures shown. The suction lines required for this operation follow all conceivable movements of the arm of the robot (2), and the design thereof is familiar to a person skilled in the art.

The drive (3) of the grinding unit with the connected gear mechanism (5) can be seen on the base frame (1) of the grinding unit. The grinding wheel spindle (4), which runs transversely to the production line and is connected to the gear mechanism, issues into the housing (6) of the extraction device.

In FIG. 1, the position sensor (7) is fitted to the tip of the cone shown in a stylized manner. The altitude of said sensor is identical to that of the upper edge of the grinding wheel (13). In FIG. 1, the grinding wheel (13) is accommodated in the housing (6) for the extraction apparatus and therefore cannot be seen here. For more details, reference is made to FIG. 4 and FIG. 5.

The position sensor (7) substantially determines the altitude of an edge of a glass sheet (11) to be processed, which is to be ground by the grinding wheel (13) and is held horizontally by the robot (2). The manner in which the position sensor (7) is fastened is not significant here; it merely has to be fixed in the region of a glass edge to be processed. The demands with respect to the positional accuracy and speed of the movements of the arm of the robot (2) are relatively high. This applies particularly to the case where the robot has to take up its desired position with the glass sheet (11) without correction.

In a preferred embodiment, the positional accuracy of a glass sheet (11) is increased and/or the speed of the positioning is increased by using further position sensors (7) to determine the exact position thereof. This can also be provided for the case where suction frames (9) which are larger than that shown are fitted to the robot (2) for processing larger glass sheets (11).

Figure 2:
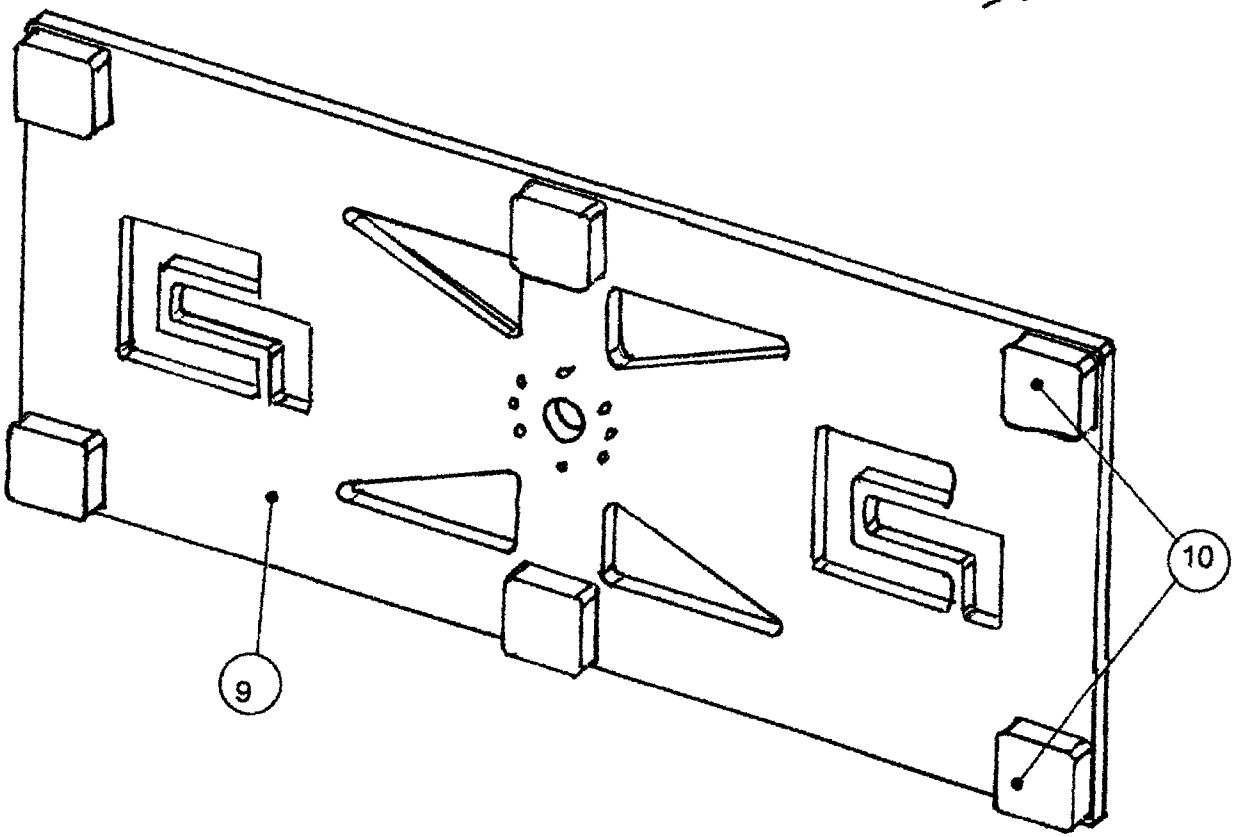
FIG. 2: is a perspective illustration of the suction frame

FIG. 2 shows a suction frame (9), provided with the company logo for display purposes, and six suction units (10) installed on the bottom side. The material of the suction frame (9) is rigid and relatively lightweight. In a preferred embodiment, Kevlar can be used as the material for the suction frame (9). The lines required for operation of the suction units (10) for supplying and distributing the vacuum, and also for producing it and guiding it via the arm of the robot (2), are not shown.

Figure 3:
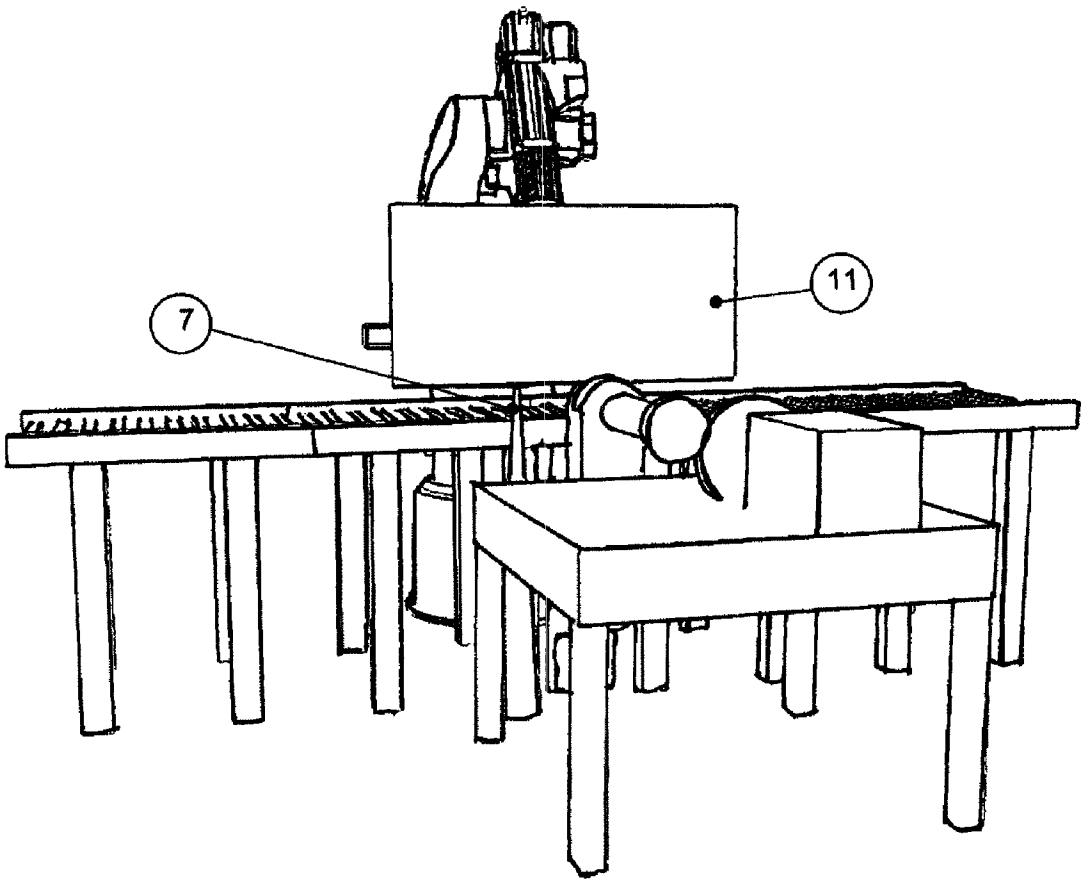
FIG. 3: is a perspective illustration of the overall apparatus during use outside a production line

FIG. 3 illustrates the overall apparatus from a normal perspective during use outside a production line. The stylized mounting of a position sensor (7) can be seen in particular in this figure. The glass sheet (11) shown is illustrated in the position in which it is processed by the grinding wheel.

Figure 4:
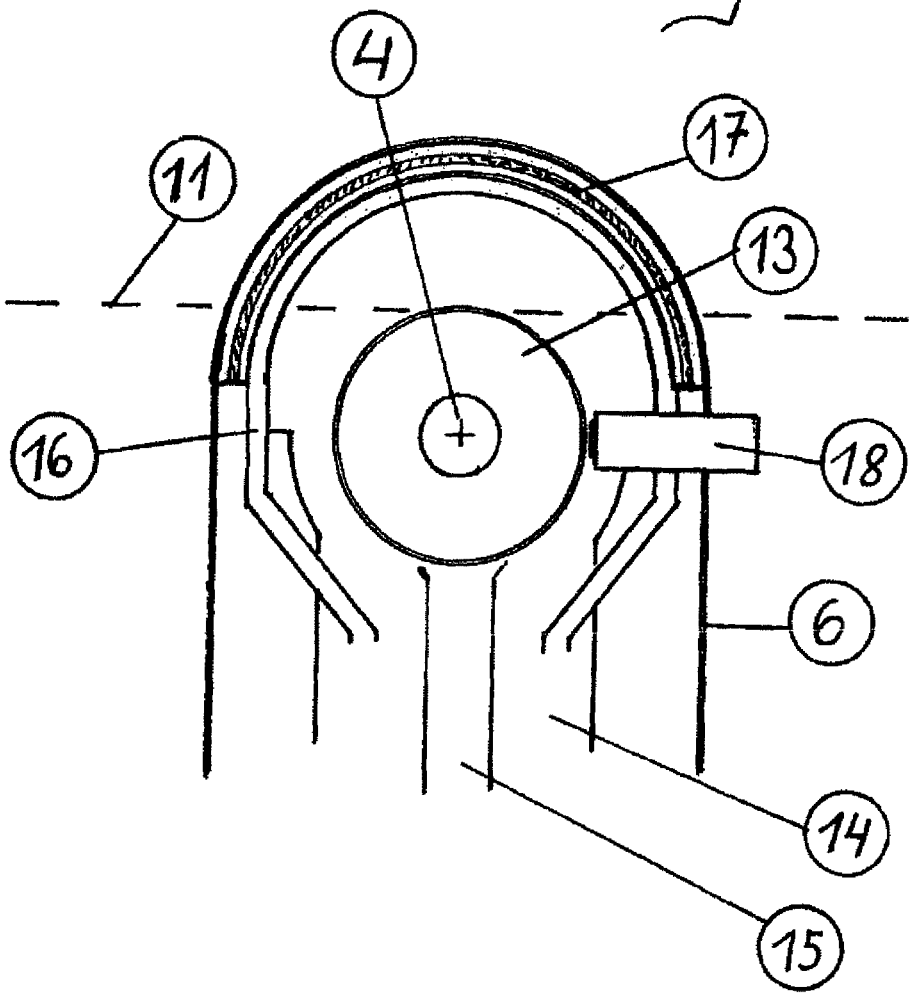
FIG. 4: is a sectional drawing through the extraction system

FIG. 4 is a sectional drawing through the extraction device. In the center, a plus sign indicates the central axes of the grinding spindle (4) and of the grinding wheel (13) driven thereby. These are bordered concentrically by the main extraction duct (14), which leads to an extraction device (not shown).

In the center of the main extraction duct (14), a grinding emulsion is supplied under pressure, upstream from the extracted air, through the duct (15). Said duct ends directly in the region of the grinding wheel (13). Any grinding emulsion which is not picked up by the grinding wheel (13) is picked up by the extraction device and fed back into the loop.

The sealing lip (17) shown in FIG. 4 serves as a boundary between the extraction device and the adjoining clean room. Said sealing lip consists of a very flexible and ductile material, which ensures that the glass sheet (11) is sealed off as effectively as possible from the surrounding clean room in the region where the grinding operation takes place. The course of the edge of a glass sheet (11) to be ground is shown as a horizontal line in FIG. 4.

In FIG. 4, an annular extraction (16) can be seen directly in front of the sealing lip (17) as a semicircle concentric with the sealing lip (17). Said annular extraction can be formed via holes, slots or comparable structures in that region of the pipeline shown which faces toward the sealing lip (17).

Here, the annular extraction (16) can take place directly via the air flow in the main extraction duct (14), or it can have a dedicated connection to the air extraction system and be regulated in intensity. Here, the output signal from a sensor (not shown in more detail) for detecting particles escaping from the sealing lip (17) serves as the reference value for this regulation.

A grinding wheel calibration device (18) detects and monitors the state of the grinding wheel (13). The general degree of wear measured by the device (18) and irregularities in the contact pattern of the surface of the grinding wheel (13) are thereby detected in good time and compared with known tolerance values. A costly damaging effect on the production line in question can thus be avoided by the timely exchange of a damaged grinding wheel (13).

The semicircular shape of the end region of the main extraction duct (14), as shown in FIG. 4, is only exemplary. A parabolic, hyperbolic or else rectangular form is likewise possible in this region.

A cleaning system (not shown here for reasons of clarity of the illustration) which is additionally to be installed and cleans the glass sheet (11) after the grinding operation is likewise advantageously provided in said end region of the main extraction duct (14). Said cleaning system advantageously consists of two cleaning elements, which each resemble a small annular brush and are arranged such that they can rotate substantially parallel to the grinding edges of a glass pane (11), where the axes of rotation of said cleaning elements, given a chamfer edge of 45 degrees, are perpendicular to one another and the rotational direction of said cleaning elements is determined such that grinding particles are conveyed into the main extraction duct (14). At the same time, the intensity of the supply of cleaning liquid and/or the rotational speed of the annular brushes described can be regulated according to the speed of advance of a glass pane (11) depending on relevant process parameters.

Figure 5:
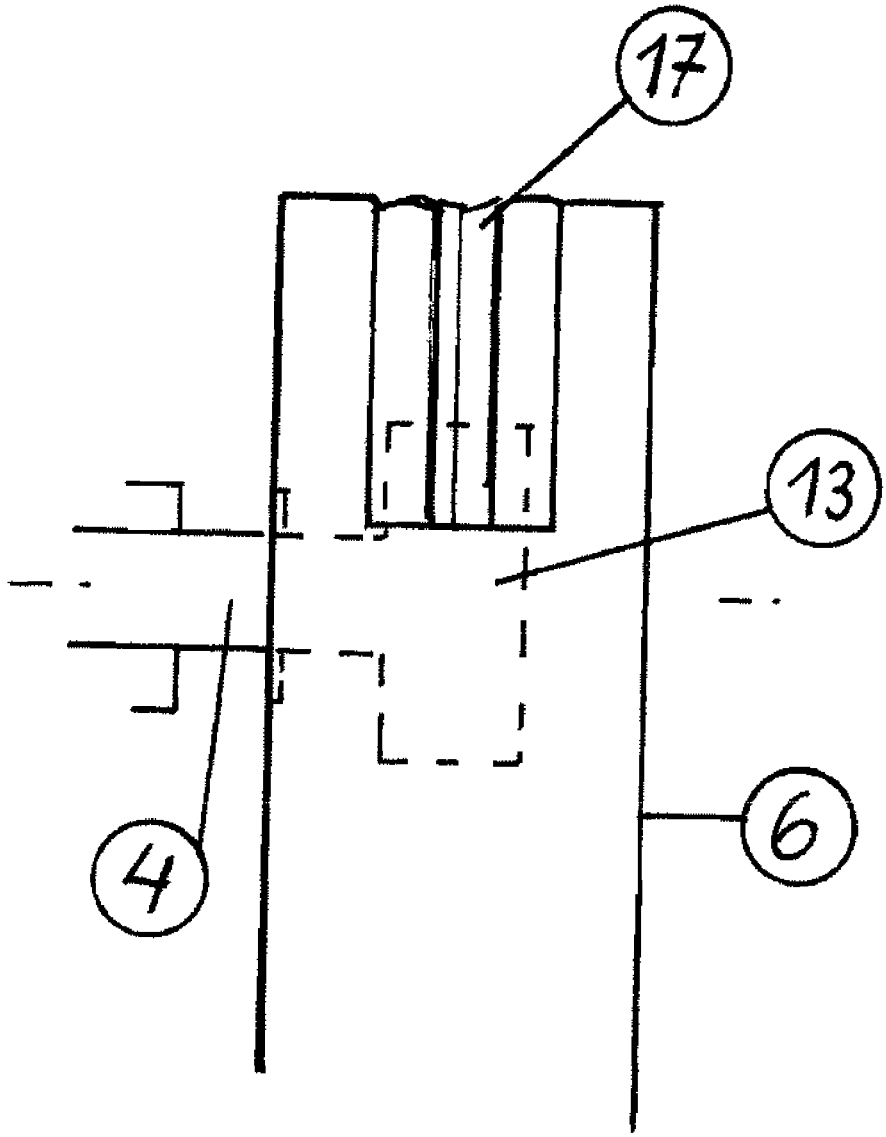
FIG. 5: is a sectional drawing through the housing of the extraction system.

FIG. 5 illustrates the extraction device of FIG. 4 in a manner rotated about a right angle. In addition to the grinding wheel spindle (4), the housing (6) for the extraction device and the grinding wheel (13), the sealing lip (17) can be seen particularly well.

The precise positioning of the glass sheet (11) can be monitored using further line lasers or using markings (not shown in more detail), the position of which is monitored using lasers and/or sensors.

A glass sheet (11) can therefore be moved with the greatest possible precision by the arm of the robot (2) and be fed for further processing by the edge grinding apparatus according to an embodiment of the invention under clean room conditions.

For adaptation to particular sizes of the glass panes (13), the grinding wheel spindle (4) is vertically adjustable. An additional sensor which detects said movement supplies corresponding parameters to the control program of the robot (2). For the quick grinding of very large glass sheets (11), the simultaneous operation of a plurality of grinding units arranged in series is preferred.

Very particular demands are made on this control program by virtue of the fact that a new edge has to be set up with respect to the position of the grinding wheel (13) immediately after an edge of a glass sheet (13) has been processed, and this operation has to take place quickly and precisely.

The interactive control of the movement elements and sensors used in each case requires a special control program.

At this point, reference is made in particular to the fact that, in contrast with other known glass grinding apparatuses, no grinding errors can occur in the case of the apparatus according to an embodiment of the invention or the corresponding process if the suction frame (9) does not position a glass sheet (11) precisely. This is because a reliable operating result is always ensured by the direct detection by control technology of the exact position of a glass sheet (11) in relation to the grinding wheel (13).

The invention claimed is:

1. An apparatus for automatically grinding an edge of a glass sheet comprising:

a) a gripper arm of a multi-axis robot bearing a suction frame having a plurality of suction units for receiving the glass sheet;

b) at least one position sensor configured to detect a position of the edge of the glass sheet and provide the multi-axis robot with the detected position data; and c) a grinding unit comprising a rotatable grinding wheel mounted in a stationary manner and installed in a pivot range of the gripper arm of the multi-axis robot;

a flexible sealing lip adjacent to the rotatable grinding wheel, the flexible sealing lip configured to cling to the glass sheet on both sides during grinding;

a duct configured to supply emulsion; and an extraction system including a main extraction duct for extracting a ground product generated during grinding, the extraction system disposed adjacent to the rotatable grinding wheel; and a calibration device in conjunction with a detection device configured to monitor a degree of wear and a state of the rotatable grinding wheel.

2. The apparatus as claimed in claim 1, further comprising at least one of a further position sensor, a line laser and a marking, the at least one of the further position sensor, the line laser and the marking configured to determine an exact position of the glass sheet.

3. The apparatus as claimed in claim 1, wherein the flexible sealing lip comprises a side facing toward the rotatable grinding wheel, the side comprising a perforated line for extracting the ground product.

4. The apparatus as claimed in claim 1, further comprising an annular extraction disposed directly in front of the flexible sealing lip as a concentric semicircle, wherein an intensity of an air flow through the annular extraction is regulated by a measuring sensor configured to detect particles escaping from the flexible sealing lip.

5. The apparatus as claimed in claim 1, further comprising a grinding wheel spindle, wherein the grinding wheel spindle is configured to be vertically adjustable, and further comprising an adjustment sensor, wherein the adjustment sensor is configured to detect an adjustable movement and configured to supply corresponding parameters to a control program of the multi-axis robot.

6. The apparatus as claimed in claim 1, further comprising a cleaning system configured to clean the glass sheet after a grinding operation, the cleaning system is disposed in an end region of the main extraction duct, the cleaning system comprising two cleaning elements, wherein each cleaning element comprises an annular brush and wherein each cleaning element is configured to rotate substantially parallel to the grinding edge of the glass sheet.

7. A method for automatically grinding an edge of a glass sheet, the method comprising:

receiving the glass sheet by a plurality of suction units, the suction units disposed on a suction frame and the suction frame connected to a gripper arm of a multi-axis robot;

detecting a position of the edge of the glass sheet by at least one position sensor;

placing the glass sheet between a flexible sealing lip, the flexible sealing lip disposed adjacent a rotatable grinding wheel, the rotatable grinding wheel disposed in a grinding unit mounted in a stationary manner in a pivot range of the gripper arm of the multi-axis robot;

supplying a grinding emulsion via a duct, the duct adjacent the rotatable grinding wheel;

grinding the edge of the glass sheet at the grinding unit;

extracting a ground product generated during grinding the edge of the glass sheet through an extraction system, the extraction system comprising a main extraction duct and the extraction system being disposed adjacent to the rotatable grinding wheel; and monitoring a degree of a wear and a state of the rotatable grinding wheel by a calibration device in conjunction with a detection device.

8. The method as claimed in claim 7, further detecting the position of the edge of the glass sheet by at least one of a further position sensor, a line laser and a marking.

9. The method as claimed in claim 7, measuring and regulating an intensity of an air flow through an annular extraction by a measuring sensor, wherein the annular extraction comprises a concentric semicircle disposed adjacent the sealing lip.

10. The method as claimed in claim 7, further comprising cleaning the glass sheet after grinding by a cleaning system, the cleaning system is disposed in an end region of the main extraction duct, wherein the cleaning system comprises two cleaning elements, each cleaning element comprises a small annular brush rotating substantially parallel to the grinding edge of the glass sheet.

11. A method for using an apparatus according to the method as claimed in claim 7, wherein the apparatus is installed either in an operating region of a production line or outside the production line.

12. A computer program with a program code for carrying out the method as claimed in claim 7, if the computer program is executed on a computer.

13. A machine-readable storage medium with a program code of a computer program for carrying out the method as claimed in claim 7, if the computer program is executed on a computer.

14. The apparatus as claimed in claim 1, wherein the rotatable grinding wheel comprises a plurality of rotatable grinding wheels.

15. The apparatus as claimed in claim 1, wherein the main extraction duct comprises a semicircular main extraction duct.

16. The apparatus as claimed in claim 1, wherein the main extraction duct comprises a parabolic main extraction duct.

17. The apparatus as claimed in claim 1, wherein the main extraction duct comprises a hyperbolic main extraction duct.

18. The apparatus as claimed in claim 1, wherein the main extraction duct comprises a rectangle main extraction duct.

19. The apparatus as claimed in claim 1, further comprising an annular extraction disposed concentrically adjacent to the flexible sealing lip.

20. The method as claimed in claim 7, wherein the rotatable grinding wheel comprises a plurality of rotatable grinding wheels.

* * * * *

UNITED STATES PATENT AND TRADEMARK OFFICE

CERTIFICATE OF CORRECTION

PATENT NO. : 8,556,680 B2
APPLICATION NO. : 12/996305
DATED : October 15, 2013
INVENTOR(S) : Egbert Wenninger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 275 days.

Signed and Sealed this
Fifteenth Day of September, 2015

Michelle K. Lee

Michelle K. Lee
*Director of the United States Patent and Trademark Office*